US005412163A

United States Patent [19]

Tsuji

[11] Patent Number: 5,412,163

[45] Date of Patent: May 2, 1995

[54] ELEVATOR CONTROL APPARATUS

[75] Inventor: Shintaro Tsuji, Inazawa, Japan

[73] Assignee: Mitsubishi Denki Kabushiki Kaisha, Tokyo, Japan

[21] Appl. No.: 32,205

[22] Filed: Mar. 15, 1993

Related U.S. Application Data

[63] Continuation of Ser. No. 705,923, May 23, 1991, abandoned.

[30] Foreign Application Priority Data

May 29, 1990 [JP] Japan ..... 2-136979
May 31, 1990 [JP] Japan ..... 2-140032

[51] Int. Cl.[6] ..... B66B 1/20
[52] U.S. Cl. ..... 187/382; 187/387
[58] Field of Search ..... 187/121, 127, 133

[56] References Cited

U.S. PATENT DOCUMENTS

| | | | |
|---|---|---|---|
| 4,760,896 | 8/1988 | Yamaguchi | 187/124 |
| 4,802,557 | 2/1989 | Umeda et al. | 187/127 |
| 4,860,207 | 8/1989 | Kubo | 187/124 |
| 4,878,562 | 11/1989 | Schroder | 187/127 |
| 4,947,965 | 8/1990 | Kuzunuki et al. | 187/127 |
| 4,989,695 | 2/1991 | Kubo | 187/124 |
| 4,990,838 | 2/1991 | Kawato | 318/568.10 |
| 4,991,694 | 2/1991 | Friedli | 187/127 |
| 5,007,162 | 4/1991 | Weeber | 29/839 |
| 5,022,498 | 6/1991 | Sasaki et al. | 187/127 |
| 5,168,135 | 12/1992 | Kubo et al. | 187/127 |
| 5,250,766 | 10/1993 | Hikita et al. | 187/133 |

FOREIGN PATENT DOCUMENTS

| | | | |
|---|---|---|---|
| 1275381 | 11/1989 | Japan | 187/133 |
| 0331173 | 2/1991 | Japan | B66B 1/18 |
| 2237663 | 5/1991 | United Kingdom | B66B 1/20 |
| 2246214 | 1/1992 | United Kingdom | 187/121 |

OTHER PUBLICATIONS

"Collective Computation in Neuronlike Circuits"; Scientific American; vol. 257, pp. 104–107; Dec. 1987., by D. Tank et al.

"Chips for the Nineties and Beyond"; BYTE; pp. 342–346; Nov. 1990., by J. Barron.

"Design of a Neural-Based A/D Converter Using Modified Hopfield Network"; IEE Journal of Solid-State Circuits, vol. 24, No. 4, pp. 1129–1135; Aug. 1989, by B. Lee et al.

*Primary Examiner*—Thomas M. Dougherty
*Attorney, Agent, or Firm*—Leydig, Voit & Mayer

[57] ABSTRACT

An elevator control apparatus determines the time required for a call to reach a hall and controls an operation of the car using the obtained estimated travel time. The elevator control apparatus includes an input data conversion unit for converting traffic data, including car position, car direction data, and data regarding car calls and hall calls into data that can be used as input data to a neural network. An estimated travel time operation unit including an input layer is provided for taking in the input data. An output layer is provided for outputting the estimated travel time. An intermediate layer is provided between the input and output layers in which a weighting factor is set. The estimated travel time operation unit comprises a neural network and an output data conversion unit for converting the estimated travel time output from the output layer into data that can be used for a predetermined control operation.

2 Claims, 12 Drawing Sheets

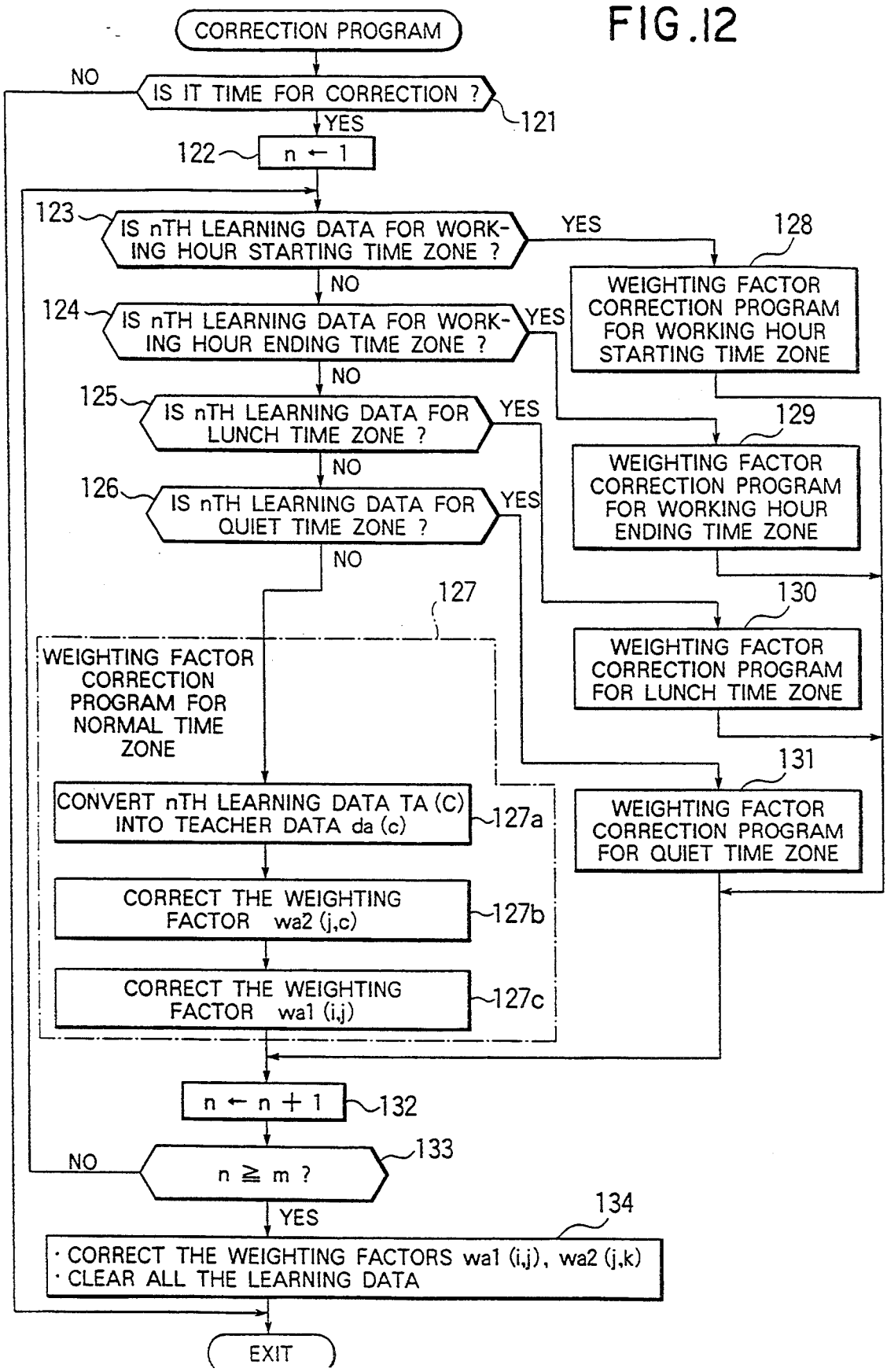
FIG.12
CORRECTION PROGRAM
IS IT TIME FOR CORRECTION ?
121
NO
YES
122
n ← 1
123
IS nTH LEARNING DATA FOR WORKING HOUR STARTING TIME ZONE ?
YES
NO
128
WEIGHTING FACTOR CORRECTION PROGRAM FOR WORKING HOUR STARTING TIME ZONE
124
IS nTH LEARNING DATA FOR WORKING HOUR ENDING TIME ZONE ?
YES
NO
125
IS nTH LEARNING DATA FOR LUNCH TIME ZONE ?
YES
NO
129
WEIGHTING FACTOR CORRECTION PROGRAM FOR WORKING HOUR ENDING TIME ZONE
126
IS nTH LEARNING DATA FOR QUIET TIME ZONE ?
YES
NO
127
130
WEIGHTING FACTOR CORRECTION PROGRAM FOR LUNCH TIME ZONE
WEIGHTING FACTOR CORRECTION PROGRAM FOR NORMAL TIME ZONE
131
CONVERT nTH LEARNING DATA TA (C) INTO TEACHER DATA da (c)
127a
WEIGHTING FACTOR CORRECTION PROGRAM FOR QUIET TIME ZONE
CORRECT THE WEIGHTING FACTOR wa2 (j,c)
127b
CORRECT THE WEIGHTING FACTOR wa1 (i,j)
127c
n ← n + 1
132
133
NO
n ≧ m ?
YES
134
· CORRECT THE WEIGHTING FACTORS wa1 (i,j), wa2 (j,k)
· CLEAR ALL THE LEARNING DATA
EXIT

ELEVATOR CONTROL APPARATUS

This application is a continuation of application Ser. No. 07/705,923, filed May 23, 1991 now abandoned.

BACKGROUND OF THE INVENTION

1. Field of the Invention

This invention relates to an elevator control apparatus which is designed to estimate the time required for each elevator car to reach each floor with a high degree of accuracy to perform elevator control which copes with various traffic statuses on the basis of the estimated time.

2. Description of the Related Art

In conventional elevator apparatus with a plurality of elevator cars incorporated therein, group control operation is generally conducted. Examples of such group control operation include the allocation method which is directed to improvement in the operation efficiency of the elevator apparatus and to shortening of the waiting time for a car. To achieve these objects, in the allocation method, an evaluated value for each car is operated immediately after a hall call is registered. The car having the best evaluated value is selected as the car to be allocated and is made to respond to the hall call.

To determine the evaluated value, the estimated waiting time for the hall call is generally used. In the elevator group control apparatus disclosed in, for example, Japanese Patent Publication No. 48464/1983, when a hall call is registered, the sum of the squares of all the estimated waiting times for the hall call when the hall call is virtually allocated to each car is obtained as the evaluated value of each car, and a car having the minimum evaluated value is selected as the car to be allocated.

In that case, the estimated waiting time is obtained by adding the period of time during which the hall call continues (the time which has elapsed by the present time after the hall call is registered) to the estimated travel time (the time required for the car to travel from the present position to the floor where the hall call is made).

The use of the thus-obtained evaluated value enables the waiting time for the hall call to be shortened (particularly enables the number of hall calls requiring waiting for more than one minute to be reduced).

However, inaccuracy of the estimated travel time makes the obtained evaluated value insignificant as the reference value with which a car to be allocated is selected, and thus hinders shortening of the waiting time for the hall call. Hence, accuracy of the estimated travel time greatly affects the performance of the group control apparatus.

The conventional methods of calculating the estimated travel time will now be described concretely.

Assuming that the car moves up and down between the two end floors, the estimated travel time is calculated in the manner described in Item (A).

(A) The time (travel time) required for the car to reach the target floor is calculated from the distance between the car position to the target floor, and then the time (stopping time) required for the car to stop at the floors located between the car position to the target floor is obtained. Thereafter, these two times are added to obtain the estimated travel time (Japanese Patent Publication Nos. 20742/1979 and 34978/1979).

To improve the accuracy with which the stopping time at the floor where the car is positioned or at the floor where the car is to make a stop is estimated, the following estimating methods have been proposed.

(B) The estimated travel time is corrected in accordance with the car state at the floor where the car is positioned (whether the speed of travel is being reduced, the door opening operation is being performed, the door is being opened, the door closing operation is being performed, the car is travelling).

(C) The number of passengers who get on or get off the car at the floor where the car is to make a stop is detected using a detection or estimation device, and the estimated travel time is corrected in accordance with the obtained values (Japanese Patent Publication No. 40072/1982 and Japanese Patent Laid-Open No. 162472/1983).

(D) The difference in the time required for the passengers to get on or get off the car due to whether the car stops the floor where the car is to make a stop in response to the car call or hall call is considered, and the estimated travel time is corrected with that difference taken into consideration (Japanese Patent Publication No. 40072/1982).

(E) The stopping time at each floor is estimated on the basis of the data obtained for each floor from the statistics of the actual stopping time (including the time required for the door opening operation to be made, the time required for the passengers to get on or get off the car, and the time required for the door closing operation to be made) or the door opening time obtained by simulation and incorporated in the group control apparatus (Japanese Patent Laid-Open Nos. 275382/1989 and 138579/1984).

To improve the accuracy with which the travel time is estimated when the possibility that a hall call is made on the floor where the car is not to make a stop and the car thus stops at that floor is considered, the following proposals from (F) to (H) have been made.

(F) The number of car calls to be generated when the car stops at the floors located between the present car position to the target floor in response to the hall call made on those floors is estimated on the basis of the statistical data on the number of passengers who get on the car, and the stopping time generated by the car calls to be generated when the estimated number of car calls is distributed to the floors located in advance of the target floor in accordance with the statistical probability distribution of the generated car calls is estimated (Japanese Patent Publication No. 34111/1988).

(G) The probability with which the car stops at each floor and in each direction is calculated from the measured values of the number of times the car changes its direction and of the number of passengers who get on or get off the car in each direction, and the estimated travel time is corrected on the basis of the results of the calculation (Japanese Patent Laid-Open No. 26872/1984).

(H) The stopping time generated by the car call at each floor is estimated from the rate with which the passengers get off the car at each floor which is obtained for each floor in each direction (Japanese Patent Publication No. 64383/1988).

The direction of travel of the car is often changed at the floor located between the present car position and the target floor due to the uppermost or lowermost call.

In order to prevent generation of errors between the estimated travel time and the actual travel time in that case, the direction of travel of the car may be changed at the floor located between the present car position and the target floor before the car reaches the final floor. The following proposals from (I) to (J) cope with that case.

(I) The time required for the car to reach the farthest floor located in the direction in which the car proceeds and the time required for the car to travel from that floor to the floor in the opposite direction where the call is made are obtained so as to operate the estimated travel time (Japanese Patent Publication No. 16293/1979).

(J) Assuming that an empty car whose direction of travel has not yet set directly goes to each floor, the estimated travel time thereof is operated (Japanese Patent Publication No. 8621/1984).

In that case, the upper reversing floor (the floor at which the car changes its direction in response to the uppermost call) is set to the floor to which the uppermost call is made, and the lower reversing floor (the floor at which the car changes its direction in response to the lowermost call) is set to the floor to which the lowermost call is made. However, when the upper reversing floor is set, if the ascending floor call is made at the floor located between the current car position to the uppermost floor, generation of new car call must be estimated. This makes the accurate setting of the uppermost reversing floor difficult. Similarly, accurate setting of the lower reversing floor is also difficult. After all, estimation of another condition, such as reversing floor, increases generation of errors.

Japanese Patent Laid-Open No. 275381/1989 discloses a group-control apparatus which selects the car to be allocated to the hall call on the basis of the operation conducted using the neural net corresponding to the neurons of the human's brain. However, no consideration is given to the improvement of the accuracy with which the estimated travel time is operated.

As stated above, in the conventional elevator control apparatus, various elements, including the present status of the car, the estimated number of passengers who get on or get off the car on each floor the car stops, the type of the present responding call, estimation of generation of the car call, estimation of allocation to a new hall call, estimation of the floor where the car changes its direction, and the current traffic on each floor, are taken into consideration in order to operate the estimated travel time with a high degree of accuracy. However, estimation of these elements with ever-changing complicated traffic taken into consideration makes the operation expressions for the estimated travel time more complicated. Now that there is a limitation to the human ability, complicated operation expressions make development of new operation expression which ensures improved operation accuracy difficult. Furthermore, detailed estimation increases the time required for the operation. This makes quick allocation of the car and forecasting of the estimated travel time impossible.

SUMMARY OF THE INVENTION

Accordingly, an object of the present invention is to provide an elevator control apparatus which is directed to overcoming the aforementioned problems of the conventional techniques and which is capable of estimating travel time with a high degree of accuracy by conducting estimation flexibly in accordance with the traffic.

In order to achieve the above object, there is provided an elevator control apparatus which comprises:

an input data conversion means for converting traffic data, including a position of the car, a direction of a movement and calls to be responded, to data that can be used as input data of a neural net;

an estimated travel time operation means including an input layer for taking in the input data, an output layer for outputting the estimated travel time, and an intermediate layer provided between said input and output layers and in which a weighting factor is set, said estimated travel time operation means constituting said neural net; and an output data conversion means for converting the estimated travel time output from said output layer into data that can be used for a predetermined control operation.

BRIEF DESCRIPTION OF THE DRAWINGS

FIG. 12 is a flowchart showing a correction program used in the program of FIG. 9.

DESCRIPTION OF THE PREFERRED EMBODIMENTS

Embodiments of the present invention will now be described with reference to the accompanying drawings.

Figure 1:
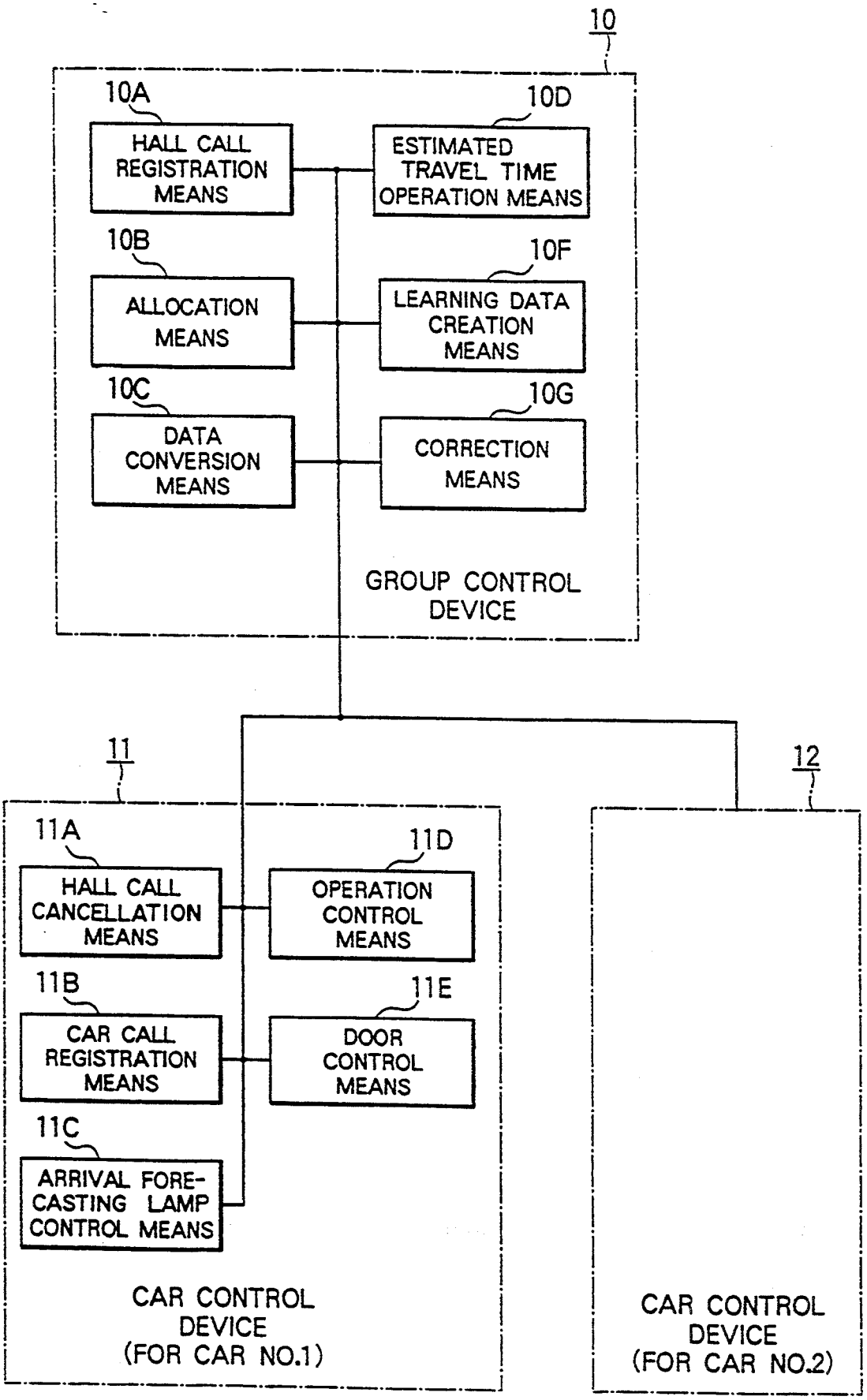
FIG. 1 is a block diagram of a first embodiment of an elevator control apparatus according to the present invention.

Referring first to FIG. 1, a group control device 10 includes a hall call registration means 10A, an allocation means 10B, a data conversion means 10C, an estimated travel time operation means 10D, a learning data creation means 10F, and a correction means 10G. The group control device 10 controls a plurality of car control devices 11 and 12 (for, for example, car Nos. 1 and 2).

The hall call registration means 10A registers and cancels the hall call on each floor (the hall call for ascent or descent), and determines the time which elapses after the hall call is registered (that is, the duration of the hall call).

The allocation means 10B selectively allocates the best serviceable car for a hall call. To accomplish this, the allocation means 10B estimates the waiting time required for each car to respond to the hall call made on each floor, and allocates the car which has the minimum sum of the squares of the individual waiting times.

The data conversion means 10C includes an input data conversion means for converting the traffic data, including the car position, direction of the movement, the call to be responded (car call or hall call to which allocation is made), into data that can be used as input data to the neural net, and an output data conversion means for converting the output data of the neural net (which corresponds to the estimated travel time) into data that can be used for a predetermined control operation (for example, for operating an estimated waiting time).

As will be described below in detail, the estimated travel time operation means 10D for determining an estimated travel time for each car in accordance with the time zone contains a neural net which includes an input layer for taking in input data, an output layer for outputting data corresponding to the estimated travel time, and an intermediate layer provided between the input and output layers and in which weighting factors are set.

The learning data creation means 10F stores the estimated travel time for each car and the input data (traffic data) when the estimated travel time is obtained and the surveyed data (teacher data) on the travel time of each car, and outputs them as learning data.

The correction means 10G learns and corrects the function of the neural net of the estimated travel time operation means 10D using the learning data.

The car control devices 11 and 12 for car Nos. 1 and 2 have the same configuration. For example, the car control device 11 for car No. 1 is constructed by the following known means 11A to 11E.

The hall call cancellation means 11A outputs a hall call cancellation signal which cancels the hall call made at each floor. The car call registration means 11B registers the car call made for each floor. The arrival forecasting lamp control means 11C controls turning on of the arrival forecasting light provided at each floor. The operation control means 11D determines direction of the travel of the car and controls travel and stoppage of the car so as to make the car responded to a car call or to a hall call to which the car is allocated. The door control means 11E controls opening and closing of the door of the car.

Figure 2:
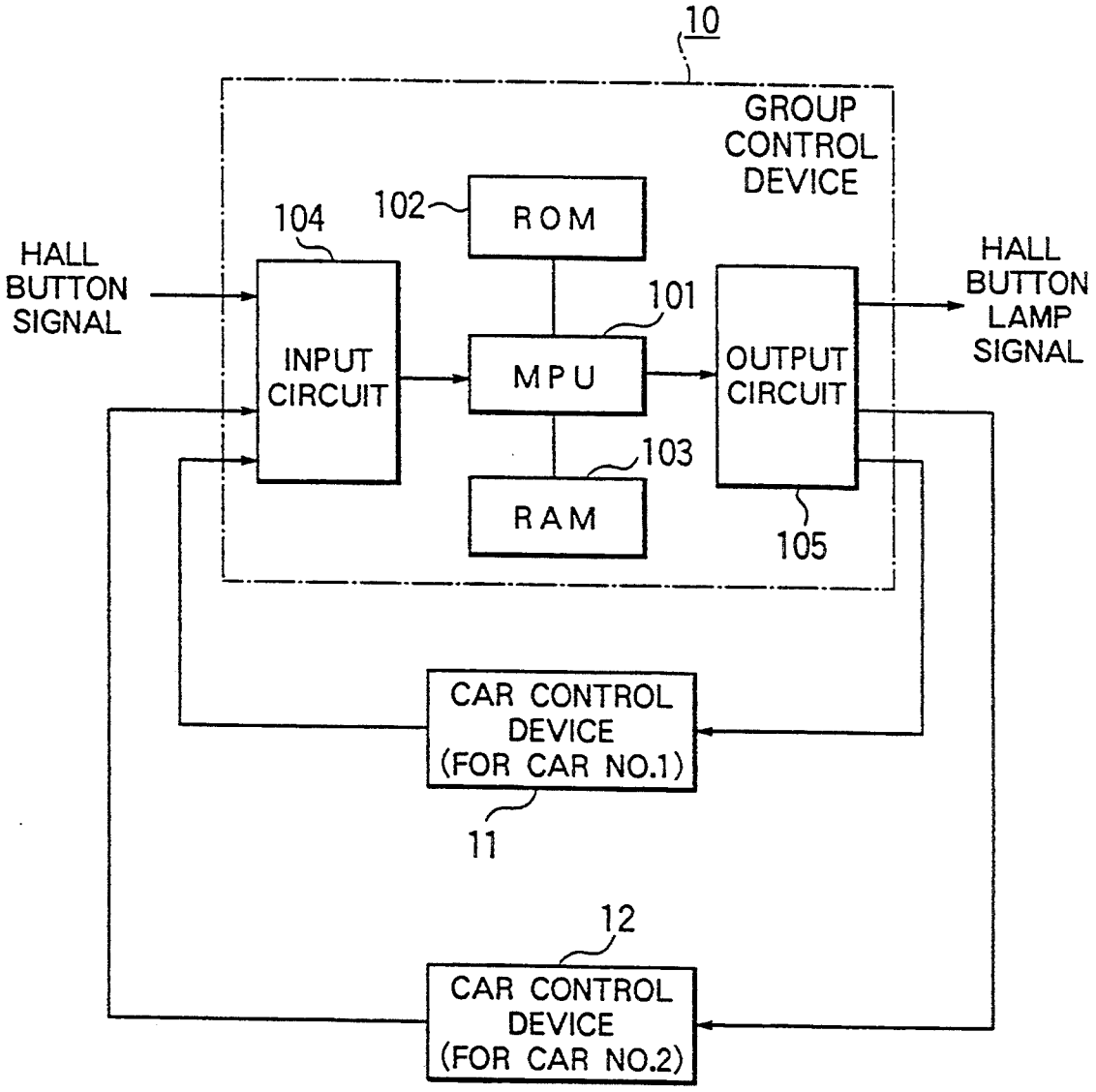
FIG. 2 is a block diagram of a group-control device of FIG. 1.

As shown in FIG. 2, the group control device 10 is a known microcomputer which is composed of a micro processing unit (MPU) or a central processing unit (CPU) 101, a ROM 102, a RAM 103, an input circuit 104, and an output circuit 105.

The input circuit 104 inputs a hall button signal 14 from a hall button provided at each floor, and status signals for car Nos. 1 and 2 from the car control devices 11 and 12. The output circuit 105 outputs a hall button lamp signal 15 to the hall button lamp incorporated in each hall button. The output circuit 105 also outputs instruction signals to the car control devices 11 and 12.

Figure 3:
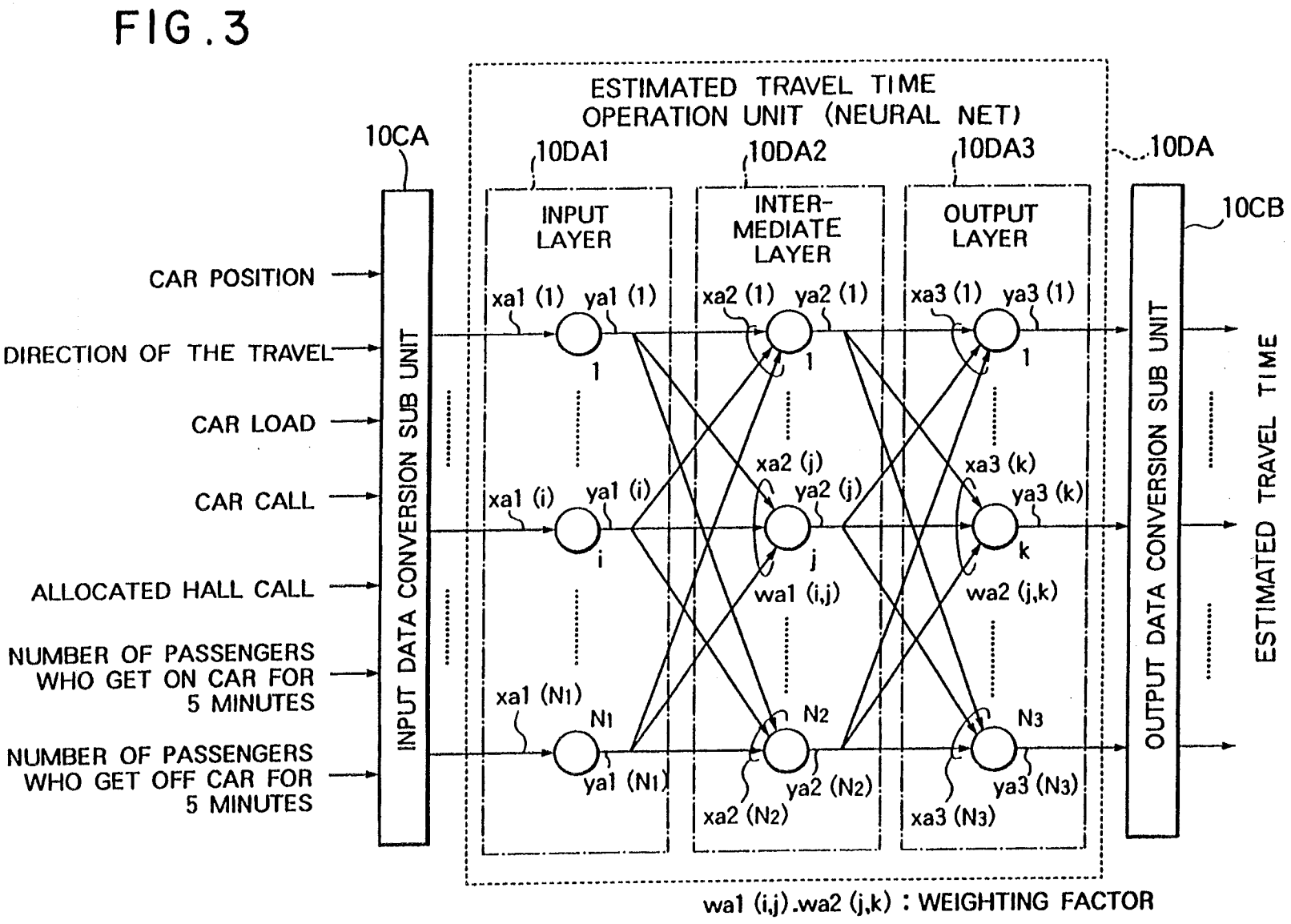
FIG. 3 is a block diagram of a data conversion means and an estimated travel time operation means of FIG. 1.

FIG. 3 is a functional block diagram concretely showing the relation between the data conversion means 10C and the estimated travel time operation means 10D shown in FIG. 1. The data conversion means 10C includes an input data conversion sub unit 10CA which serves as the input data conversion means and an output data conversion sub unit 10CB which functions as the output data conversion means. An estimated travel time operation unit 10DA consisting of a neural net is inserted between the input data conversion sub unit 10CA and the output data conversion sub unit 10CB. The estimated travel time operation unit 10DA includes the estimation operation sub routine used in the estimated travel time operation means 10D shown in FIG. 1.

The input data conversion sub unit 10CA converts the traffic data, including the car position, direction of the movement, the car load, the call to be responded (that is, car call and the hall call to which the car is allocated), the statistic feature of the traffic (the number of people who get on the car for five minutes and the number of people who get off the car for five minutes), into data that can be used as the input data to the neural net 10DA (neural network data).

The output data conversion sub unit 10CB converts the output data (corresponding to the estimated travel time) of the neural net 10DA into data that can be used for calculating the evaluated value for a hall call allocation operation.

The estimated travel time operation (control data) unit 10DA which consists of the neural net is made up of an input layer 10DA1 for taking in the input data from the input data conversion sub unit 10CA, an output layer 10DA3 for outputting data corresponding to the estimated travel time, and an intermediate layer 10DA2 provided between the input and output layers 10DA1 and 10DA3 and in which weighting factors are set.

The layers 10DA1 to 10DA3 are connected to each other by the network, and are each constructed by a plurality of nodes.

Let N1, N2 and N3 respective be the numbers of nodes of the input layer 10DA1, intermediate layer 10DA2 and output layer 10DA3. Then, the number of nodes N3 of the output layer 10DA3 is expressed as follows:

$$N3=2\ (FL-1)$$

where FL is the number of floors in a building. The number of nodes N1 of the input layer 10DA1 and the number of nodes N2 of the intermediate layer 10DA2 are respectively determined in accordance with the number of floors FL of the building, the types of input data used, the number of cars and so on.

When the variables i, j and k take $i=1, 2, \ldots, N1$ $j=1, 2, \ldots, N2$ $k=1, 2, \ldots, N3$ the input and output values of the ith node of the input layer 10DA1 are expressed by xa1(i) and ya1 (i), the input and output values of the jth node of the intermediate layer DA2 are expressed by xa2(j) and ya2(j), and the input and output values of the kth node of the output layer 10DA3 are expressed by xa3(k) and ya3(k).

When the weighting factor between the ith node of the input layer 10DA1 and the jth node of the intermediate layer 10DA2 is wa1(i, j) and the weighting factor between the jth node of the intermediate layer 10DA2 and the kth node of the output layer 10DA3 is wa2(j, k), the relations between the input and output values of the individual nodes are expressed as follows:

$$ya1(i) = 1/[1 + \exp\{-xa1(i)\}] \quad (1)$$

$$xa2(j) = \sum_{i=1}^{N1} \{wa1(i, j) \times ya1(i)\} \quad (2)$$

$$ya2(j) = 1/[1 + \exp\{-xa2(i)\}] \quad (3)$$

$$xa3(k) = \sum_{i=1}^{N2} \{wa2(j, k) \times ya2(j)\} \quad (4)$$

$$ya3(k) = 1/[1 + \exp\{-xa3(k)\}] \quad (5)$$

where $0 \leqq wa1(i, j) \leqq 1$ and $0 \leqq wa2(j,k) \leqq 1$.

The group control operation conducted in this embodiment will be described below with reference to the flowchart shown in FIG. 4.

First, the group control device 10 takes in the hall button signal 14 and the status signals from the car control devices 11 and 12 in accordance with a known input program in step 31. The status signal input to the group control device 10 contains the car position, direction of the travel, stoppage or travel, the door opened/closed state, the car load, the car call, and the hall call deletion signal.

Next, in step 32, the hall call is registered or cancelled, the hall button lamp is turned on or off, and the duration of the hall call is operated in accordance with a known hall call registration program.

Next, in step 33, it is determined whether or not a new hall call C is registered. If the answer is yes, an estimated travel time Ta1(k) of car No. 1 relative to each hall k (=1, 2, . . . , N3) when the new hall call C is virtually allocated to car No. 1 is operated in step 34 in accordance with the program of estimating travel time when car No. 1 is virtually allocated.

Similarly, in step 35, an estimated travel time Ta2(k) of car No. 2 relative to each hall k (=1, 2, . . . , N3) when the new hall call C is virtually allocated to car No. 2 is operated in accordance with the program of estimating travel time when car No. 2 is virtually allocated.

In subsequent steps 36 and 37, the program of estimating travel time when the new hall call C is ignored and is not allocated to either car No. 1 or No. 2 (at the time of non-allocation) is executed to operate the estimated travel time Tb1(k) and Tb2(k) of car Nos. 1 and 2 relative to each hall.

Next, in step 38, evaluated values W1 and W2 are determined on the basis of the estimated travel time Ta1(k), Ta2(k), Tb1(k) and Tb2(k) determined in steps 34 to 37, and a car which has the minimum evaluated values is selected as a car to be allocated. An allocation instruction corresponding to the hall call C and a forecasting instruction are assigned to the car to be allocated. The evaluated values W1 and W2 may be determined using the method described in, for example, Japanese Patent Laid-Open No. 48464/1983.

Next, in step 39, the hall button lamp signal 15 set in the manner described above is sent out to the corresponding hall and the allocation signal and the forecasting signal are sent out to the car control device 11 or 12 using an output program.

Next, in step 40, the converted traffic data, the estimated travel time for each hall and the surveyed data on the travel time for each car are stored and output as learning data in accordance with a learning data creation program.

In step 41, the weighting factors for the network in the estimated travel time operation means 10D are corrected in accordance with the learning data and a correction program.

The group control device 10 performs group control over the plurality of elevator cars by executing the processings from step 31 to step 41 repetitively.

If it is determined in step 33 that the new hall call C is not registered, the process goes from step 33 to step 39.

Next, the operation of the travel time estimation program executed in the process of step 34 will be described concretely with reference to FIG. 5 as an example of the processes from step 34 to step 37.

First, in step 50, the new hall call C is virtually allocated to car No. 1, and allocated hall call data to be input to the input data conversion sub unit 10CA is created.

In step 35, the new hall call C is virtually allocated to car No. 2, and allocated hall call data is created. In the processes of steps 36 and 37, allocated hall call data when no allocation is made is used as the allocated hall call data.

Next, in step 51, the data on the car on which the estimated travel time is to be determined (including the car position, direction of the movement, the car call and the allocated hall call) and the data representing the statistical feature of the traffic at the present time are taken out from among the traffic data which is input, and the data is converted into data xa1(1) to xa1(N1) that can be input to the individual nodes of the input layer 10DA1 of the estimated travel time operation unit 10DA.

If the number of floors FL of the building is twelve, and if the hall No. f=1, 2, . . . , 11 respectively represent the ascending halls on the first, second, . . . , eleventh floors while the hall No. f=12, 13, . . . , 22 respectively represent the descending halls on the twelfth, eleventh, . . . second floors, the state of a car "in which the car positioned floor is f and in which the direction of movement is upward" is expressed as follows:

xa1(f)=1 xa1(i)=0

(i=1, 2, . . . 22, i≠f)

The state of the car is expressed using a value normalized within a range from 0 to 1.

"1" is assigned to the car calls, xa1(23) to xa1(34), made relative to the first to twelfth floors when they are registered, and "0" is assigned to the car calls when they are not registered. "1" is assigned to the ascending hall calls, xa1(35) to xa1(45), made on the first to eleventh floors when they are allocated, and "0" is assigned to the ascending hall calls when they are not allocated. "1" is assigned to the descending hall calls, xa1(46) to xa1(56), made on the twelfth to second floors when they are allocated, and "0" is assigned to them when they are not allocated.

The numbers of passengers, xa1(57) to xa1(67), who get on the ascending car for five minutes on the first to eleventh floors are normalized to a value ranging from 0 to 1 by dividing the numbers of passengers per five minutes obtained from the statistics of the past traffic by the maximum value NNmax (for example, one hundred passengers) that the numbers of passengers can take. The numbers of passengers, xa1(68) to xa1(78), who get on the descending car for five minutes on the twelfth to second floors, the numbers of passengers, xa1(79) to xa1(89), who get off the ascending car for five minutes on the first to eleventh floors, and the numbers of passengers, xa1(90) to xa1(100), who get off the descending car for five minutes on the twelfth to second floors are respectively normalized by dividing the statistic numbers by the maximum value NNmax.

The method of normalizing the input data is not limited to the above-described method but the car position and the direction of the movement may be expressed separately. For example, the input value xa1(1) of the first node which represents the car positioned floor when the car positioned floor is f may be expressed by $$xa1(1)=f/FL$$

"+1" may be assigned to the input value xa1(2) of the second node which represents the direction of the movement of the car when the car is ascending, "−1" may be assigned to the input value xa1(2) when the car is descending, and "0" may be assigned to the input value xa1(2) when the car is moving in no direction.

Once the input data to be input to the input layer 10DA1 is set in step 51, the network operation is performed in steps 52 to 56 to estimate the travel time obtained when the new hall call C is virtually allocated to car No. 1.

First, in step 52, the output value ya1 (i) of the input layer 10DA1 is calculated from Equation (1) using the input data xa1(i).

Subsequently, in step 53, the input value xa2(j) of the intermediate layer 10DA2 is calculated from Equation (2) by multiplying the output value ya1(i) obtained by Equation (1) by the weighting factor wa1(i, j) and by totalling the resultant values regarding i=1 to N1.

Next, in step 54, the output value ya2(j) of the intermediate layer 10DA2 is calculated by Equation (3) using the input data xa2(j) obtained by Equation (2).

Subsequently, in step 55, the input value xa3(k) of the output layer 10DA3 is calculated from Equation (4) by multiplying the output value ya2(j) obtained from Equation (3) by the weighting factor wa2(j, k) and by totalling the resultant values regarding j=1 to N2.

Thereafter, in step 56, the output value ya3(k) of the output layer 10DA3 is calculated from Equation (5) using the input value xa3(k) obtained by Equation (4).

Once the network operation on the estimated travel time is completed, the output data conversion sub unit 10CB shown in FIG. 1 converts the output values ya3(1) to ya3(N3) in step 57 to determine the final estimated travel time.

At that time, the individual nodes of the output layer 10DA3 correspond to the halls for opposite directions: the output values ya3(1) to ya3(11) of the first to eleventh nodes are respectively used to determine the calculated values of the estimated travel time for the ascending halls on the first, second, . . . , eleventh floors, and the output values ya3(12) to ya3(22) are respectively used to determine the calculated values of the estimated travel time for the descending halls.

That is, the output value ya3(k) of the kth node is converted into the estimated travel time T(k) of the hall k which is expressed as follows:

$$T(k)=ya3(k)\times NTmax \quad (6)$$

where NTmax is the constant value which represents the maximum value of the estimated travel time. Since the output value ya3(k) of the kth node is normalized to a value ranging from 0 to 1, it is converted to a value which can be used for calculating the evaluated value of the hall call allocation by multiplying it in the maximum value NTmax by Equation (6).

In the travel time estimation program, the relation of cause and effect between the traffic and the estimated travel time is expressed in the form of a network, and the traffic data is taken into the neural net to operate an estimated travel time. Consequently, an estimated travel time which is very close to an actual travel time can be obtained with a high degree of accuracy that cannot be realized by the conventional methods. Furthermore, since the car to be allocated to the hall call is selected on the basis of the estimated travel time, the waiting time for the hall call can be shortened, and occurrence of car full or passenger left-off conditions can be reduced.

However, since the network changes as a consequence of changes in the weighting factors wa1(i, j) and wa2(j, k) which connect the individual nodes in the neural net 10DA, the estimated travel time can be determined further adequately by appropriately changing and correcting the weighting factors wa1(i, j) and wa2(j, k) through learning.

Next, the operations performed in the learning data creation and correction programs (steps 40 and 41) executed by the learning data creation and correction means 10F and 10G will be described with reference to FIGS. 6 and 7.

Learning (correction of the network) is effectively performed using the back propagation method. The back propagation is a method of correcting the weighting factors which connect the network using an error between the output data of the network and a desired output data (teacher data) created from surveyed data or a control objective value.

Figure 6:
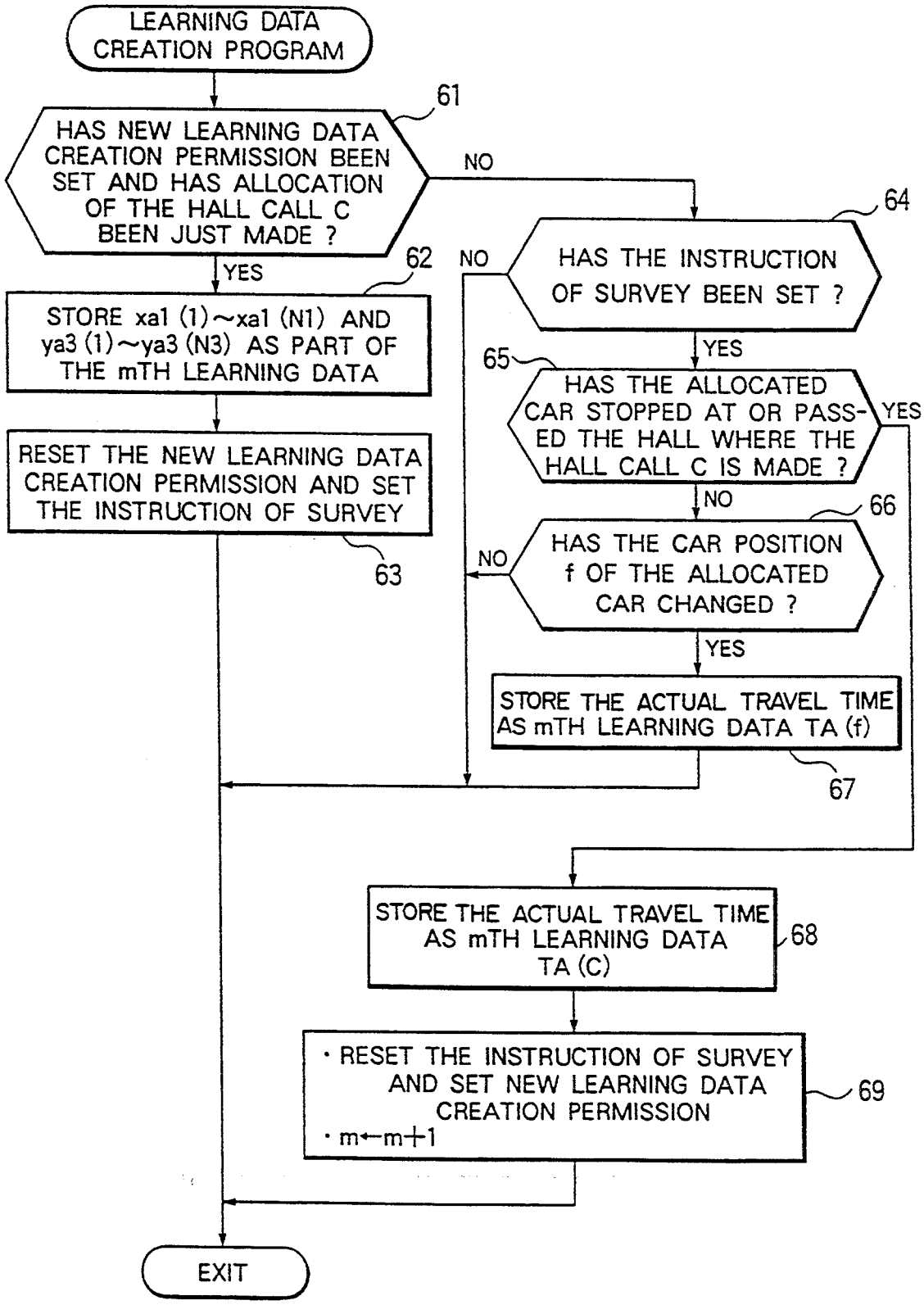
FIG. 6 is a flowchart showing a learning data creation program used in the program of FIG. 4.
Figure 7:
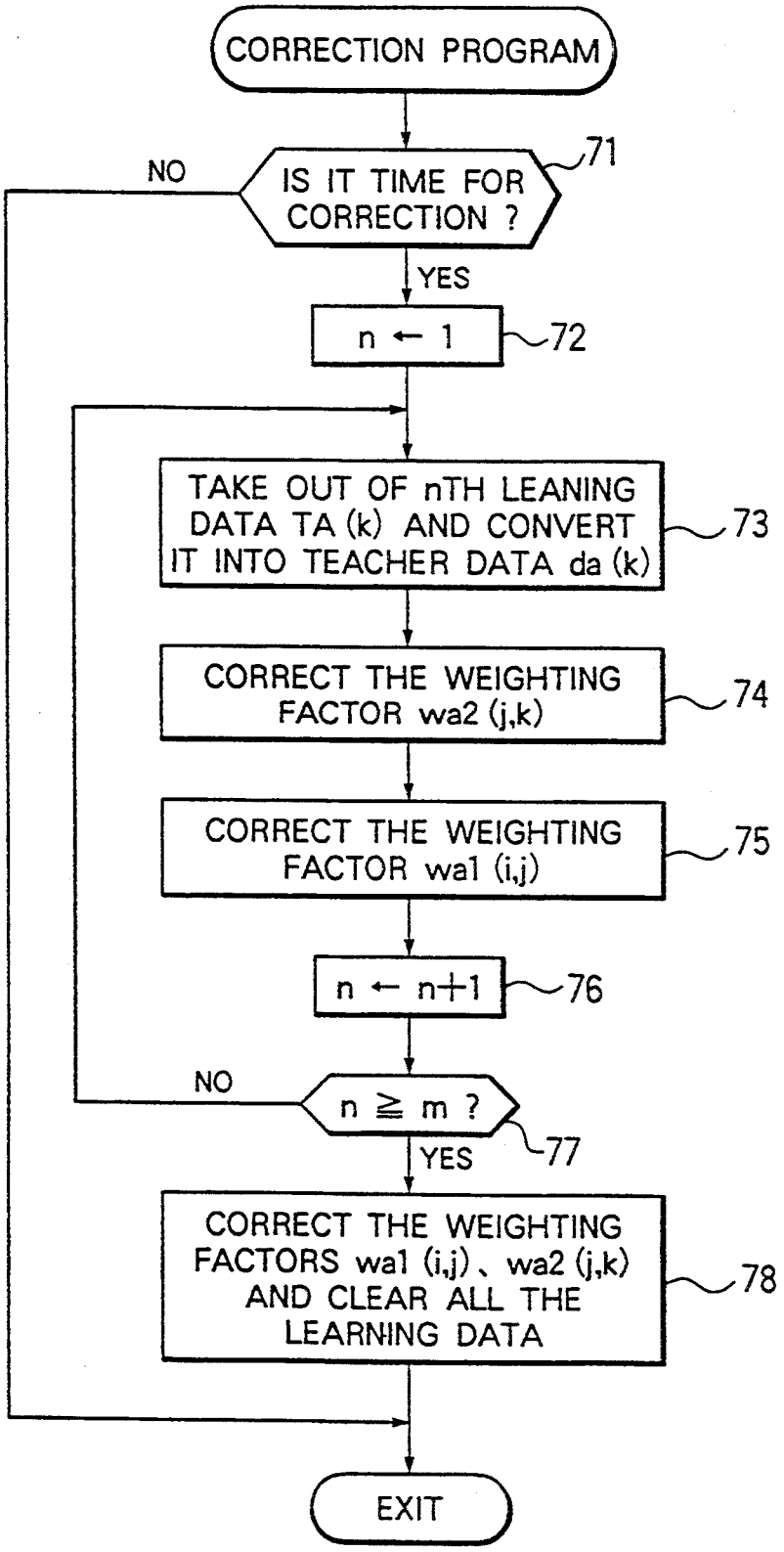
FIG. 7 is a flowchart showing a correction program used in the program of FIG. 4.

In the flowchart of the learning data creation program shown in FIG. 6, it is determined in step 61 whether or not the new learning data creation permission has been set and whether or not allocation of the new hall call C has just been made.

If the learning data creation permission has been set and if allocation of the hall call C has been made, the traffic data xa1(1) to xa1(N1) on the allocated car when allocation is made and the output data ya3(1) to ya3(N3) corresponding to the estimated travel time on the individual halls are stored as part of the mth learning data (teacher data) in step 62.

Subsequently, in step 63, new learning data creation permission is reset, and the instruction of surveying travel time is set and counting of the actual travel time is thereby started.

If it is determined in step 61 in the subsequent operation period that, the new learning data creation permission is not set, and the process goes to step 64 in which it is determined whether or not the instruction of surveying the travel time is set. Since the survey instruction has already been set in step 63, the process goes to step 65 and it is determined whether or not the allocated car has responded to the hall call C.

If the allocated car has not stopped at or has not passed the hall where the hall call C is made, it is determined in step 66 whether or not the car position f of the allocated car has changed.

If the change in the car position f is detected in a subsequent operation period, the actual travel time obtained when the car position f has changed is stored as part of the mth learning data in step 67. This is the original teacher data and is expressed by the actual travel time TA(f) at the hall represented by the car position f.

If it is determined in step 65 that the allocated car has stopped at (or passed) the hall where the hall call C is made in a subsequent operation period, the process proceeds to step 68 and the actual travel time obtained when the detection is made is stored as part of the mth learning data, i.e., as the actual travel time TA(C).

Thereafter, the instruction of surveying the travel time is reset and counting of the actual travel time is thereby completed, and the learning data No. m is incremented and the new learning data creation permission is set in step 69.

In this way, the input and output data on the allocated car, as well as the actual travel time on the individual halls the allocated car stops or passes by the time it responds to the hall call C, are created and stored as the learning data synchronously with the allocation of the allocated car to the hall call.

Figure 4:
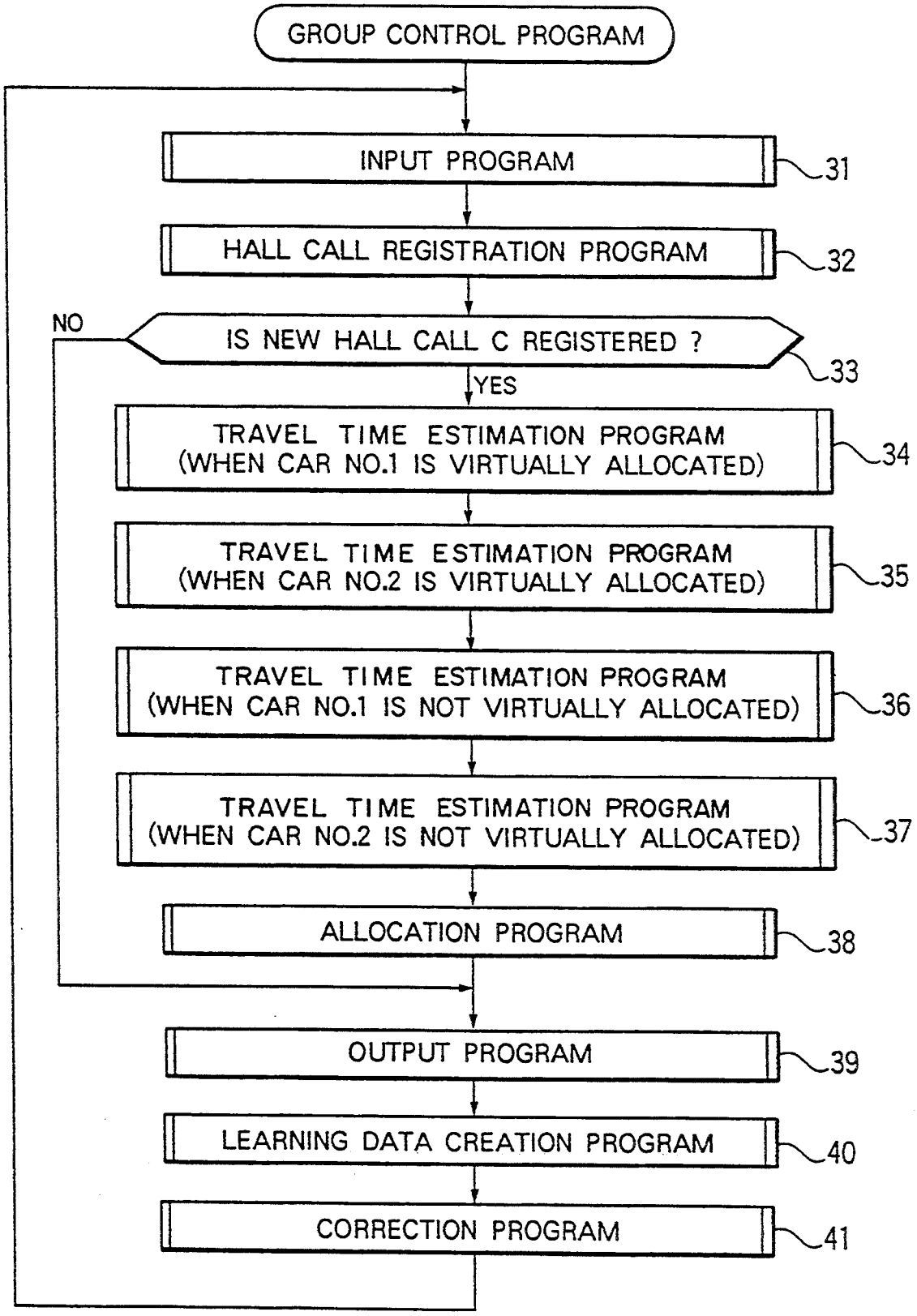
FIG. 4 is a flowchart showing a group control program used in the first embodiment.

Next, the correction means 10G corrects the neural net 10DA using the learning data in accordance with the correction program (in step 41) shown in FIG. 4.

The correction operation performed by the correction means will now be described in detail with reference to FIG. 7.

First in step 71, it is determined whether or not the time correction of the network is to be made. If the answer is yes, the processes from steps 72 to 78 are executed.

In this embodiment, correction of the network is made when the number m of learning data sets has reached S (for example, 500). The reference number S for the learning data may be set freely in accordance with the size of the network, e.g., in accordance with the number of elevators installed, the number of floors FL of the building, and the number of hall calls.

If it is determined in step 71 that the number m of learning data sets has reached S, the counting No. n of the learning data is initialized to '1' in step 72. Thereafter, in step 73, the actual travel time TA(k) is taken out from among the nth learning data, and the value of the node corresponding to the hall of the actual travel time, i.e., the teaching data da(k) (k=1, 2, . . . , N3), is obtained by the following equation:

$$da(k)=TA(K)/NTmax \tag{7}$$

Next, the error Ea between the output value ya3(1) to ya3(N3) of the output layer 10DA3 taken out from among the nth learning data and the teacher data da(1) to da(N3) is obtained by the following equation:

$$Ea = \sum_{k=1}^{N3} [\{da(k) - ya3(k)\}^2]/2 \tag{8}$$

In step 74, the weighting factor wa2 (j, k) (j=1, 2, . . . , N2, k=1, 2, . . . N3) between the intermediate layer 10DA2 and the output layer 10DA3 is corrected using the error Ea obtained by Equation (8) as follows:

First, variation Δwa2(j, k) in the weighting factor is obtained as follows by differentiating the error Ea obtained by Equation (8) by wa2(j, k) and by re-arranging the resultant value using Equations (1) to (5):

$$\begin{aligned} \Delta wa2(j, k) &= -\alpha \{\partial Ea/\partial wa2(j, k)\} \\ &= -\alpha \cdot \delta a2(k) \cdot ya2(j) \end{aligned} \tag{9}$$

where α is a parameter which represents the learning rate. A given value ranging from 0 to 1 is assigned to α. In equation (9), $$\delta a2(k)=\{ya3(k)-da(k)\}\ ya3(k)\ \{1-ya3(k)\}$$

Once the variation Δwa2(j, k) of the weighting factor wa2(j, k) has been calculated, the weighting factor wa2(j, k) is corrected as follows:

$$wa2(j, k) \leftarrow wa2(j, k)+\Delta wa2(j, k) \tag{10}$$

Thereafter, the weighting factor wa1(i, j) (i=1, 2, . . . , N1, j=1, 2, . . . , N2) between the input layer 10DA1 and the intermediate layer 10DA2 is corrected similarly in step 75 in accordance with the following Equations (11) and (12).

First, variation Δwa1(i, j) of the weighting factor wa1(i, j) is obtained by the following equation:

$$\Delta wa1(i, j)=-\alpha.\delta al(j).ya1(i) \tag{11}$$

where δa1(j) is expressed as follows:

$$\delta a1(j) = \sum_{k=1}^{N3} \{\delta a2(k) \cdot wa2(j, k) \cdot ya2(j) \times [1 - ya2(j)\}$$

The weighting factor wa1(i, j) is corrected using the variation Δwa1(i, j) obtained by Equation (11) as follows:

$$wa1(i, j) \leftarrow wa1(i, j)+\Delta wa1(i, j) \tag{12}$$

In steps 74 and 75, only the weighting factors associated with the halls whose teacher data is present are corrected. That is, as stated above in connection with the learning data creation program shown in FIG. 6, the actual travel times for only the halls located between the car position when the allocation is made and the hall where the hall call C is made are stored as the teacher data.

Once correction has been made using the nth learning data in steps 73 to 75, the learning data No. n is incremented in step 76, and the processes from step 73 to 76 are then repeated until it is determined in step 77 that correction has been made on all the learning data (until n≧m).

Once correction on all the learning data has been completed, the corrected weighting factors wa1(i, j) and wa2(j, k) are registered in the estimated travel time operation means 10D in step 78.

At that time, all the learning data used for correction is cleared so that new learning data can be stored, and the learning data No. m is then initialized to "1", thereby completing the network correction (learning) for the neural net 10DA.

Thus, the learning data is created on the basis of the surveyed values, and the weighting factors wa1(i, j) and wa2(j, k) for the estimated travel time operation means 10D are respectively corrected using the learning data. It is therefore possible to automatically cope with changes in the traffic in the building.

Furthermore, since the statistically obtained numbers of passengers who get on and get off the elevator on each hall for five minutes are also used as the input data representing the feature of the traffic, more flexible and accurate estimation can be made as compared with the case in which the car position, the direction of the movement and the call to be responded alone are used as the input data which represents an ever-changing traffic.

In the above-described embodiment, the input data conversion means performs conversion on the car position, the direction of the movement, and the calls to be responded. However, the traffic data used as the input data is not limited to the above-described ones. For example, the status of the car (the speed is being decreased, the door opening operation is being made, the door is being opened, the door closing operation is being made, the car is waiting with its door closed, and the car is moving), the duration of the hall call, the duration of the car call, the car load, and the number of cars on which group control is performed may also be used as the input data. Furthermore, not only the current traffic data but also the traffic data in the near future (the history of the car's movement or that of the car's response to the call) may also be used as the input data. In this way, more accurate operation of the estimated travel time is made possible.

Furthermore, in the above-described embodiment, the learning data creation means 10F stores as the learning data set the estimated travel time of the allocated car for each floor, the input data when allocation of the hall call C is made, and the actual travel time for each hall at which the allocated car stops or passes before it responds to the hall call when allocation of the hall call is made. However, the timing of the creation of the learning data is not limited to the above-described case. For example, the learning data may be created a predetermined period of time (for example, one minute) after the previous input data has been stored. Alternatively, the learning data may be created cyclically (for example, at an interval of one minute). Furthermore, since the learning conditions are improved as the number of learning data obtained under various conditions increases, the learning data may be created when any of previously determined typical statuses of the car is detected, e.g., when the car is stopped at a predetermined floor or when the car is in a predetermined state (the speed is being decreased, the car is at a stop, and so on).

Furthermore, in the above-described embodiment, the learning data creation means 10F stores as the teaching data only the actual travel time for each floor at which the allocated car stops or passes by the time it responds to the allocated hall call, and the correction means 10G performs correction only on the weighting factor which is associated with the stored teaching data. However, the method of extracting the teaching data is not limited to the above-described method. For example, the estimated travel time for all the halls and the actual travel time that can be measured during the movement of the car may be stored, and only the weighting factor associated with the hall on which the teacher data is present may be corrected. The halls whose actual travel time cannot be measured correspond to those which are located farther than the floor at which the direction of the movement of the car is reversed. In the case where the direction of the movement of the car is reversed at a floor located in advance of the objective floor, the halls whose actual travel time cannot be reversed correspond to those located farther than the floor at which the car becomes empty. In the case where the car (to which no hall call is allocated) becomes empty before it reaches the objective floor, the halls whose actual travel time cannot be reversed correspond to those located at the rear of the car positioned floor (for example, those located below the present position of the car when the car is ascending) when the input data is stored.

Furthermore, the estimated travel time operation means 10D corrects the weighting factor each time the number of stored learning data reaches a predetermined number. However, the timing in which the weighting factor is corrected is not limited to the above-described case. For example, the weighting factor may be corrected at a predetermined time (for example, at an interval of one hour) using the already stored learning data. Alternatively, the weighting factor may be corrected when the traffic becomes less and the frequency with which the estimated travel time operation means 10D operates the estimated travel time is reduced.

Figure 8:
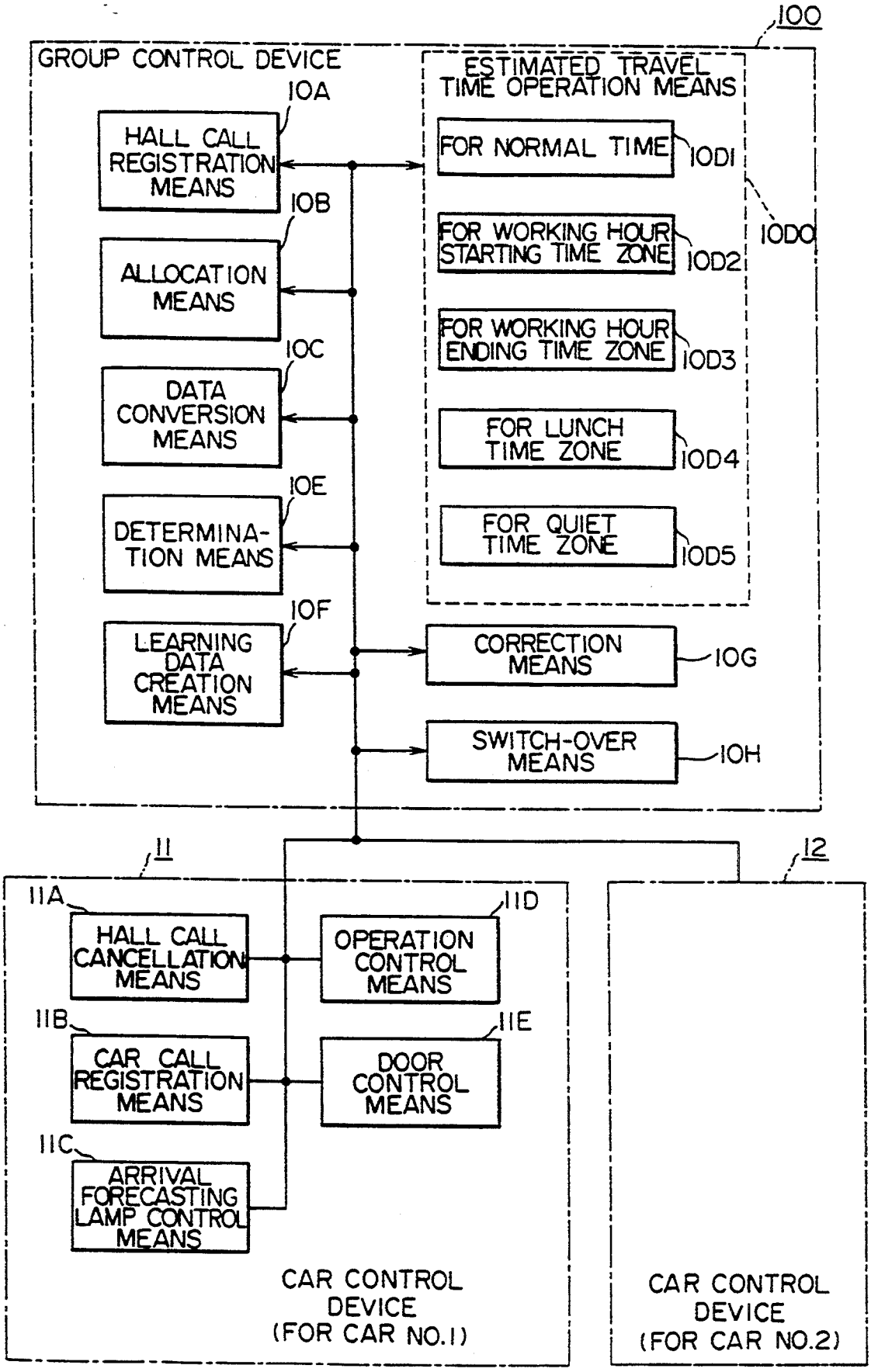
FIG. 8 is a block diagram of a second embodiment of an elevator control apparatus according to the present invention.

Turning to FIG. 8 which is a block diagram of an elevator control apparatus, a second embodiment of the present invention will now be described. A group control device 100 includes a hall call registration means 10A, an allocation means 10B, a data conversion means 10C, an estimated travel time operation means 10D0, a determination means 10E, a learning data creation means 10F, a correction means 10G, and a switch-over means 10H. The group control device 100 controls a plurality of car control devices 11 and 12.

The hall call registration means 10A, the allocation means 10B, the data conversion means 10C, the learning data creation means 10F, and the correction means 10G respectively have the same configurations as those shown in FIG. 1. The estimated travel time operation means 10D0 includes an operation means 10D1 for the normal time zone, an operation means 10D2 for the working hour starting time zone, an operation means 10D3 for the working hour ending time zone, an operation means 10D4 for lunch time zone, and an operation means 10D5 for quiet time zone. Each of the operation means 10D1 to 10D5 has the similar network configuration to that shown in FIG. 3.

The neural net in each of the operation means 10D1 to 10D5 is, however, different from that shown in FIG. 3 in that it does not use the traffic data (the number of passengers who get on the car in five minutes and the number of passengers who get off the car in five minutes). In this case, assuming that the number of floors in the building is twelve, the number of nodes M1 of the input layer 10DA1 which is fifty six is obtained by subtracting the forty four from the number of nodes N1 (=100), as the number of passengers who get on the car on each hall in ascending or descending direction and the number of passengers who get off the car on each floor in ascending or descending direction are deleted from the input data. The number of nodes M2 for the intermediate layer 10DA2 is also set to a value which is smaller than N2 shown in FIG. 3 because of decrease in the number of input data.

The determination means 10E determines the traffic pattern to which the current elevator traffic state belongs, and the switch-over means 10H selects either of the plurality of estimated travel time operation means 10D1 to 10DS. It is to be noted that the plurality of traffic patterns representing the elevator traffic states are provided for each of the plurality of time zones.

The group control operation conducted in the second embodiment will be described below with reference to the flowchart shown in FIG. 9.

First, the group control device 100 executes a known input program and thereby takes in the hall button signal 14 and the status signals from the car control devices 11 and 12 in step 81. The status signal input to the group control device 100 includes the car position, direction of the travel, stoppage or travel, the door opened/closed state, the car load, the car call, and the hall call cancelling signal.

Next, in step 82, the hall call is registered or cancelled, turning on or off of the hall button lamp is determined, and the duration of the hall call is operated in accordance with a known hall call registration program.

Next, in step 83, a known determination program is executed to determine which time zone the current elevator traffic state belongs to.

That is, the time zone to which the current elevator traffic state belongs to is selected from among the working time starting time zone (8:30 to 9:10), the working hour ending time zone (17:00 to 17:30), the lunch time zone (11:50 to 13:10), the quiet time zone (0:00 to 8:30 and 19:00 to 24:00) and the normal time zone (the time zone other than the aforementioned time zones) using, for example, the output of a clock (not shown) built in the group control device 100.

Next, in step 84, it is determined whether or not a new hall call C is registered. Once the newly registered hall call C is detected, evaluated values W1 and W2 of the waiting times when the hall call C is allocated to both the car Nos. 1 and 2 are operated in steps 85 to 89 (Japanese Patent Publication No. 48464/1983). A car having the minimum evaluated values W1 and W2 is selected as the normal car to be allocated, and the allocation instruction and forecasting instruction, corresponding to the hall call C, are then set on the car to be allocated.

That is, the travel time estimating program when car No. 1 is virtually allocated is executed in step 85 to operate an estimated travel time Ta1(k) of car No. 1 relative to each hall k (=1, 2, . . . , N3) when the new hall call C is virtually allocated to car No. 1.

Similarly, in step 86, the travel time estimating program when car No. 2 is virtually allocated is executed to operate an estimated travel time Ta2(k) of car No. 2 relative to each hall k (=1, 2, . . . , N3) when the new hall call C is virtually allocated to car No. 2.

In subsequent steps 87 and 88, the travel time estimating program when the new hall call C is ignored and is not allocated to either car No. 1 or No. 2 (at the time of non-allocation) is executed to operate the estimated travel time Tb1(k) and Tb2(k) of car Nos. 1 and 2 relative to each hall.

The operation of the travel time estimating program 85 when car No. 1 is virtually allocated will be described below concretely with reference to FIG. 10.

First, in step 93, the new hall call C is virtually allocated to car No. 1, and allocated hall call data to be input to the input data conversion sub unit 10CA is created.

Next, in steps 94 to 97, the switch-over means 10H selects one program from the estimated travel time operation programs (steps 98, 110 to 113) respectively corresponding to the estimated travel time operation means 10D1 to 10D5 on the basis of the results of the determination made by the determination program (step 83) in the determination means 10E.

Figure 10:
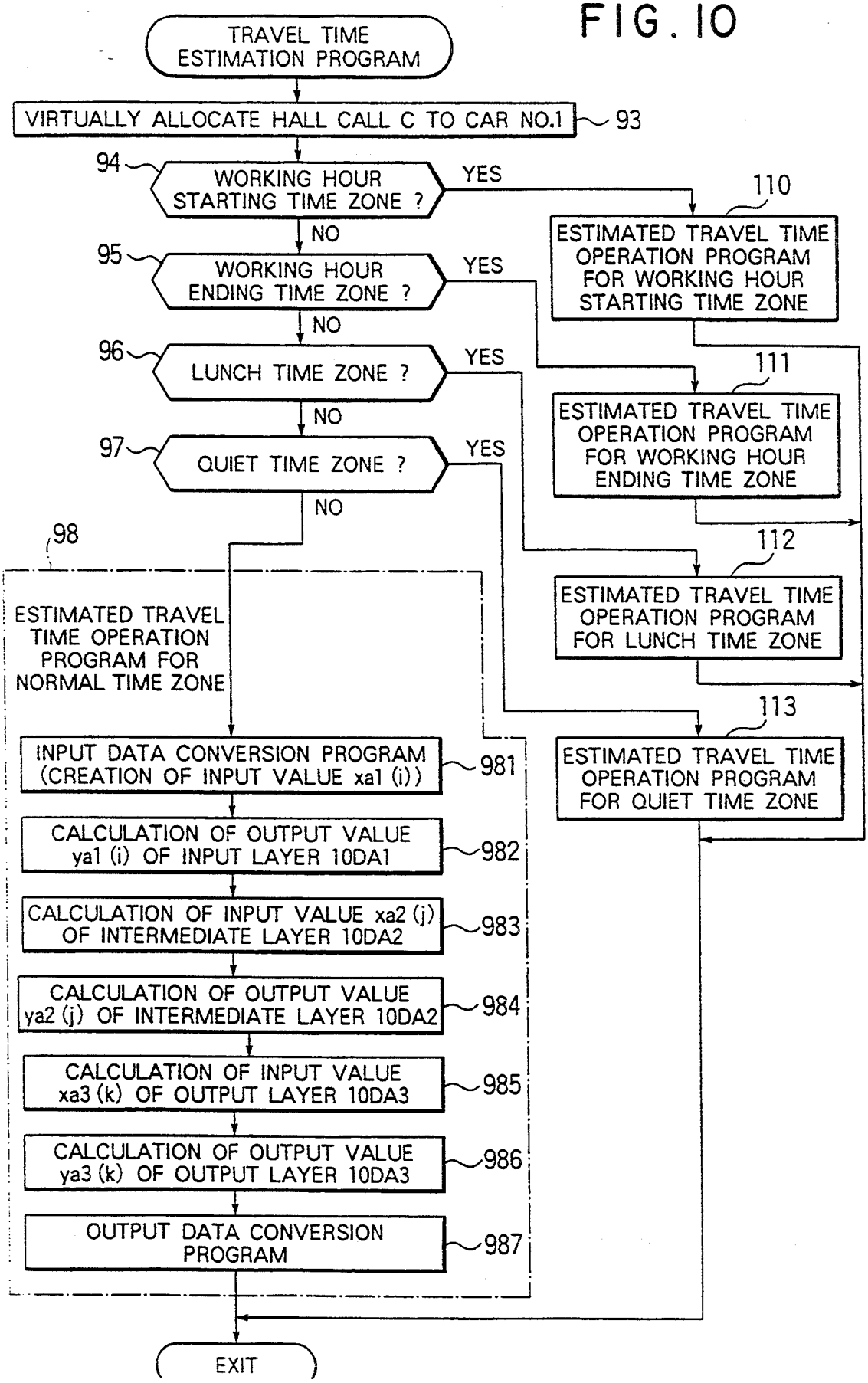
FIG. 10 is a flowchart showing an estimated travel time operation program used in the program of FIG. 9 when the car is virtually allocated.

Although FIG. 10 shows concretely only the estimated travel time operation program for normal time zone (step 98), each of the estimated travel time operation programs (steps 110 to 113) is similar to the operation program of step 98.

If it is determined by the determination program (step 83) in the determination means 10E that the current elevator traffic state belongs to the normal time zone, the process goes to the estimated travel time operation program (step 98) through the working hour starting time zone determining step 94, the working hour ending time zone determining step 95, the lunch time zone determining step 96 and the quiet time zone determining step 97.

Figure 5:
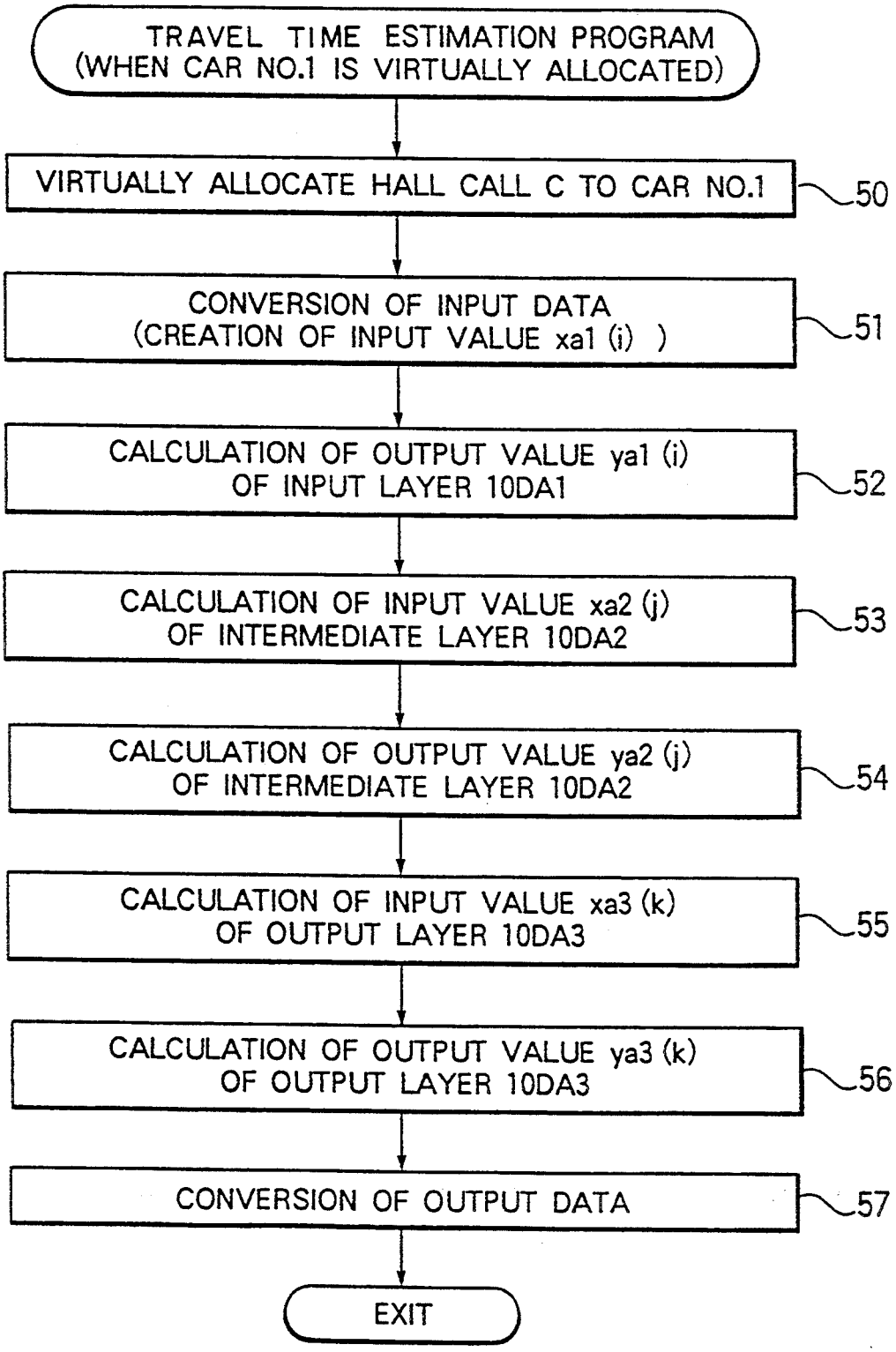
FIG. 5 is a flowchart showing an estimated travel time operation program used in the program of FIG. 4 when the car is virtually allocated.

The individual steps 981 to 987 in step 98 respectively correspond to steps 51 to 57 in the first embodiment shown in FIG. 5. In the network similar to that shown in FIG. 3, the values for the normal time zone are set as the weighting factors wa1 (i, j) (i=1,2, . . . , M1, j=1, 2, . . . M2) and wa2 (j, k).

In the input data conversion program (step 981), the data on car No. 1 (including the car position, direction of the travel, the car call and the allocated hall call) are taken out from among the traffic data, and the data which is taken out from the traffic data is converted into data xa1(1) to xa1(i) that can be used in the network operation. Here, i=1, 2, . . . , M1 (M1<N1). Thereafter, the network operation is executed in steps 982 to 987 to obtain the estimated travel time Ta1(k) (k=1, 2, . . . , N3), as in the case of steps 52 to 57 in FIG. 5.

If it is determined that the current elevator traffic state belongs to any of the time zones corresponding to steps 94 to 97, the corresponding estimated travel time operation program (either of steps 110 to 113) is executed in a similar manner. In each network, weighting factors corresponding to each time zone are set as the weighting factors wa1 (i, j) and wa2 (j, k) (i=1,2, . . . , M1, j=1, 2, . . . M2, k=1, 2, . . . , N3).

In the individual travel time estimation programs 85 to 88, as the traffic data is deleted from the input data, the number of input data is reduced from 100 to 56. At the same time, the number of nodes of the intermediate layer 10DA2 is also reduced. Furthermore, the single estimated travel time operation program corresponding to the current traffic state is selected from the estimated travel time operation programs (steps 98, 110 to 113) made up of a plurality of neural nets. Corresponding to the neural nets are a plurality of time zones and estimated travel times Ta1(k), Ta2(k), Tb1(k) and Tb2(k) for car Nos. 1 and 2 which are respectively determined using the selected programs. Accordingly, the estimated travel time can be determined in a short period of time and with a high degree of accuracy.

Figure 9:
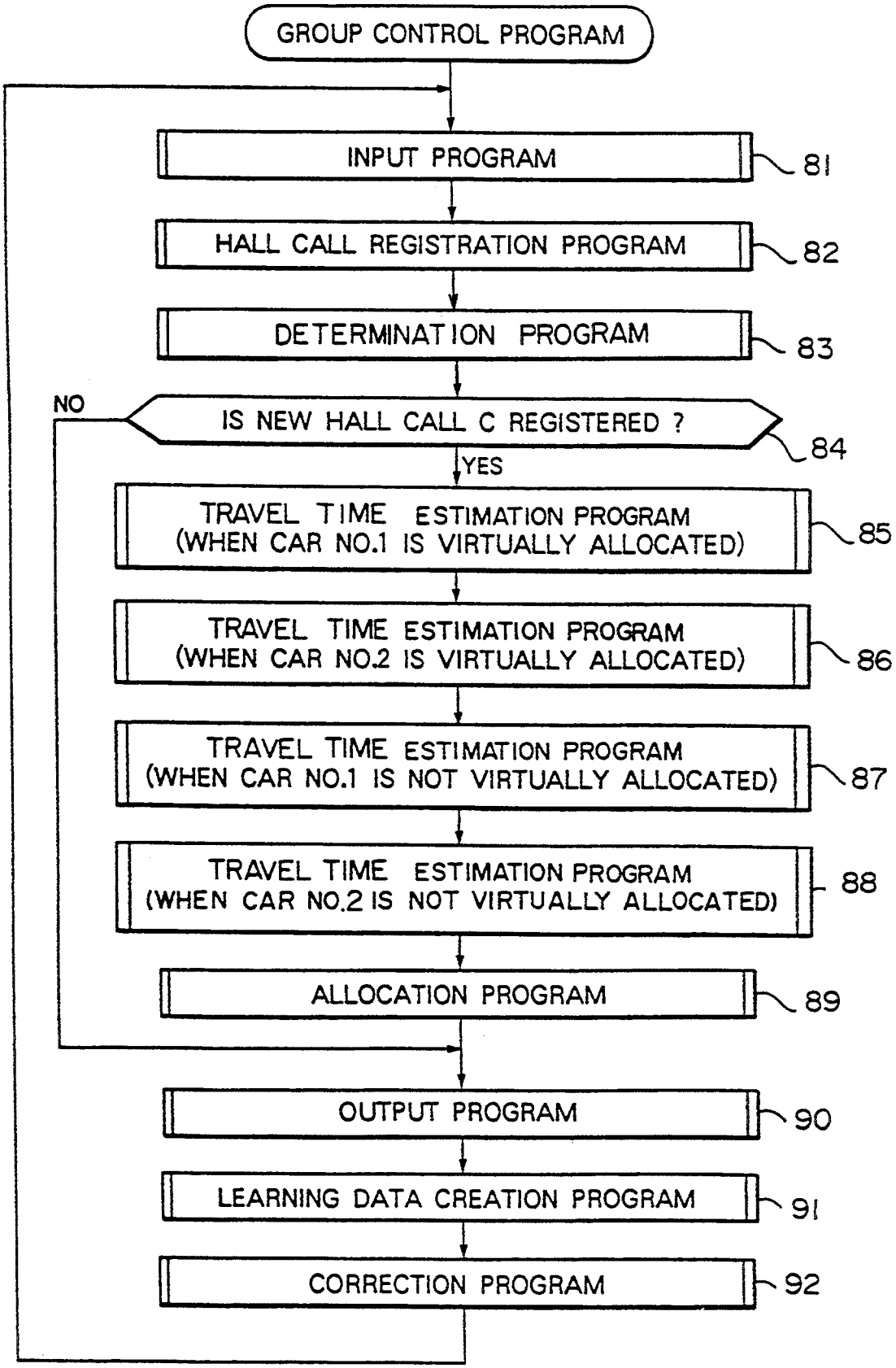
FIG. 9 is a flowchart showing a group control program used in the second embodiment.

The thus-obtained estimated travel time is used to calculate the evaluated values W1 and W2 of the waiting time in step 89 in FIG. 9 in which the allocation program is executed.

Next, in step 90, an output program is executed, and the hall button lamp signal 15 set in the manner described above is thereby sent out to the corresponding hall while the allocation signal and the forecasting signal are sent out to the car control devices 11 and 12.

Next, in step 91, a learning data creation program is executed, and the converted traffic status data, the estimated travel time for each hall and the surveyed data on the travel time for each car are thereby stored and output as the learning data. In step 92, a correction program is executed, and the weighting factors for the networks in the estimated travel time operation means 10D0 are corrected using the learning data.

Next, the operations performed in the learning data creation and correction programs (steps 91 and 92) executed by the learning data creation and correction means 10F and 10G will be described with reference to FIGS. 11 and 12.

Figure 11:
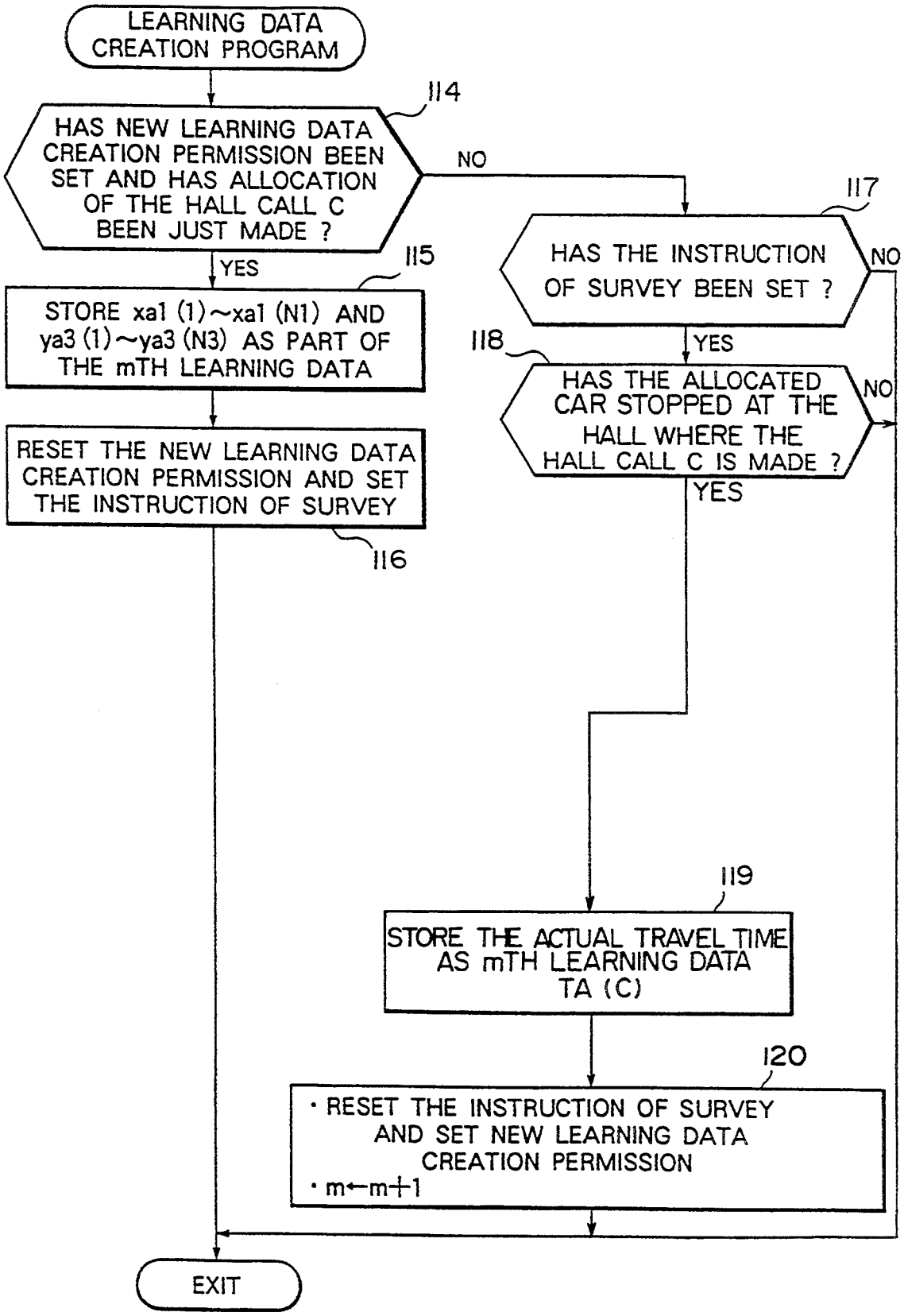
FIG. 11 is a flowchart showing a learning data creation program used in the program of FIG. 9.

In the learning data creation program shown in FIG. 11, it is first determined in step 114 whether or not the new learning data creation permission has been set and whether or not allocation to the new hall call C has just been made.

If the learning data creation permission has been set and if allocation to the hall call C has been made, the traffic data xa1(1) to xa1(M1) on the car to be allocated when allocation is made and the output data ya3(1) to ya3(N3) corresponding to the estimated travel time on the individual halls are stored as part of the mth learning data (teacher data) in step 115.

Subsequently, in step 116, new learning data creation permission is reset, and the instruction of surveying an actual travel time is set and counting of the actual travel time is thereby started.

Hence, it is determined in step 114 in the subsequent operation period that the new learning data creation permission is not set, so the process goes to step 117 in which it is determined whether or not the instruction of surveying the travel time is set. Since the survey instruction has already been set in step 116, the process goes to step 118 and it is determined whether or not the car to be allocated has responded to the hall call C.

If it is determined in step 118 that the car to be allocated has stopped at the hall where the hall call C is made in a subsequent operation period, the process proceeds to step 119 and the actual travel time obtained when the detection is made is stored as part of the mth learning data. This is the original teacher data and is expressed by the actual travel time TA(C) for the hall where the hall call C is made.

Thereafter, the instruction of surveying the travel time is reset and counting of the actual travel time is thereby completed, and the learning data No. m is incremented and the new learning data creation permission is set in step 120.

Thus, the learning data on the car allocated to the hall call and on the new hall call C are repeatedly creased and stored each time allocation to the hall call is made.

Next, the correction means 10G executes the correction program shown in FIG. 9 (step 92), and thereby corrects the network of the neural net 10DA using the learning data. The correction operation performed by the correction means will now be described in detail with reference to FIG. 12.

First in step 121, it is determined whether or not it is the time correction of the network is to be made. If the answer is yes, the processes from steps 122 to 134 are executed.

In this embodiment, correction of the network is made when the number m of currently stored learning data sets has reached S (which may be 400). The reference number S for the determination of the learning data may be set freely in accordance with the number of elevators installed, the number of floors FL of the building and the size of the network, such as the number of hall calls.

If it is determined in step 121 that the number m of learning data sets has reached S, the counting No. n of the learning data is initialized to '1' in step 122. Thereafter, it is determined which time zone the nth learning data correspond to (in steps 123 to 126) so as to select one correction program to be used from among the plurality of correction programs (steps 127 to 131). Although FIG. 12 shows only the weighting factor correction program (step 127) for the normal time zone concretely, each of the other correction programs (steps 128 to 131) is similar to the program of step 127.

If it is determined that the nth learning data is the data for the normal time zone, the process goes to correction step 127 through the determination steps 123 to 126, and the weighting factor Correction program for the normal time zone is selectively executed. The individual steps 127*a* to 127*c* in step 127 respectively correspond to steps 73 to 75 in FIG. 7.

That is, the actual travel time TA(C) is taken out from among the nth learning data, and the teaching data da(c) is obtained in step 127*a*. Thereafter, the weighting factor wa2 (j, C) (j=1, 2, . . . , M2) between the intermediate layer 10DA2 and the output layer 10DA3 is corrected in step 127*b*, and then the weighting factor wa1 (i, j) (i=1, 2, . . . , M1) between the input layer 10DA1 and the intermediate layer 10DA2 is corrected in step 127*c*.

If the nth learning data is the data for the working hour starting time zone, the weighting factor correction program for the working hour starting time zone is selected in step 128 by the determination made in step 123 and the weighting factor in the estimated travel time operation program (step 110) for the working hour starting time zone, shown in FIG. 10, is thereby corrected. Similarly, if the nth learning data is the data for the working hour ending time zone, the weighting factor correction program for the working hour ending time zone is selected in step 129 by the determination made in step 124. If the nth learning data is the data for the lunch time zone, the weighting factor correction program for the lunch time zone is selected in step 130 by the determination made in step 125. If the nth learning data is the data for the quiet time zone, the weighting factor correction program for the quiet time zone is selected in step 131 by the determination made in step 126. The concrete correction procedures are the same as those in the first embodiment, detailed description being omitted.

Once correction has been made using the nth learning data in steps 123 to 131, the learning data No. n is incremented in step 132, and the processes from step 123 to 132 are then repeated until it is determined in step 133 that correction has been made on all the learning data (until $n \geqq m$).

Once correction on all the learning data has been completed, the corrected weighting factors wa1(i, j) and wa2(j, k) are registered in the estimated travel time operation means 10D0 in step 134.

At that time, all the learning data used for correction is cleared so that new learning data can be stored, and the learning data No. m is then initialized to "1", thereby completing the network correction (learning) for the neural net 10DA for each time zone.

Since the learning data is created for each time zone, and the network of the estimated travel time operation means is corrected for each time zone, the amount of learning data used for correction can be reduced and the learning period required for correction can be shortened as compared with the case where the network of the estimated travel time operation means 10D0 made up of the single neural net is corrected. It is therefore possible to operate the estimated travel time in a short period of time and with a high degree of accuracy even when the traffic changes in various ways.

In the second embodiment, the determination means 10E determines which time zone the current elevator traffic state belongs to on the basis of the output of the clock. However, determination may also be made in other ways. For example, the determination may be made when the number of passengers (car load) in the car which starts from the crowded floor or the number of passengers who get on the car on the crowded floor reaches a predetermined value. In that case, the type of time zone is adequately set in accordance with the traffic conditions in the building. Alternatively, a plurality of types of typical traffic patterns (such as a pattern in which traffic is heavy in the ascending direction, a pattern in which traffic is heavy in the descending direction and so on) may be prepared independently of the time zones, and the traffic pattern to which the current traffic belongs may be determined on the basis of the surveyed values of the traffic data in the near past (for example, in the past five minutes).

When the learning data is stored by the learning data creation means 10F, it may stored in sequence for each time zone in the storage area corresponding to each time zone. In this way, the amount of data to be stored as the learning data can be reduced.

Furthermore, the correction means 10G for correcting the weighting factors for the estimated travel time operation means 10D0 corrects the weighting factor each time the number of stored learning data m reaches a predetermined number S. However, the weighting factor correction may be timed in different ways. For example, the weighting factor may be corrected at a predetermined time (for example, at intervals of one hour) using the already stored learning data. Alternatively, the weighting factor may be corrected when the traffic becomes less and the frequency with which the estimated travel time operation means 10D operates the estimated travel time is reduced. Alternatively, the number of learning data mA, mB, . . . , mE for individual time zones may be counted, and the weighting factor for each time zone may be corrected each time the corresponding number of data reaches a predetermined value SA, SB, . . . , SE.

In the above embodiments, the neural net is used to operate the estimated travel time required to estimate the movement of the car in the near future. The neural net can also be applied to the operation of estimated items which are used in the allocation of the car to the hall call or other group control operations. For example, the neural net may be applied to the estimation of probability of wrong forecasting, probability of full packing, car load at each floor or generation of car call.

What is claimed is:

1. An elevator control apparatus for controlling the operation of elevator cars comprising:

an input data conversion means for converting traffic data, including position of each car, direction of travel of each car and existence of car calls and hall calls into neural network data;

a plurality of neural networks each corresponding to a plurality of time zones in which different traffic patterns are exhibited, each of said neural networks including an input layer for receiving all the data from said input data conversion means, an output layer for outputting signals representative of estimated travel parameters to be used in car allocation, and an intermediate layer provided between the input and output layers for simultaneously processing all the neural network data in which weighting factors are set and corrected based on learning data derived in part from actual travel times of each car;

a determination means for determining which traffic patterns the current elevator traffic status corresponds to;

a switch-over means for selecting one of said plurality of neural networks on the basis of the results of the determination made by said determination means; and an output data conversion means for converting the estimated travel parameters output from the output layer of the neural network selected by said switch-over means into control data;

allocation means for allocating a selected car to a hall call based on the estimated travel parameter signals for the selected car represented by control data output from said output data conversion means;

whereby the selected car is allocated to a hall call on the basis of the estimated travel parameter.

2. An elevator control apparatus according to claim 1, further comprising a learning data creation means; connected to said output data conversion means for storing the estimated travel time for a predetermined hall in the traffic pattern selected on the basis of the results of the determination made by said determination means and the input data, for counting and storing the time which has passed until the car stops at or passes said predetermined hall as an actual travel time, and for outputting the stored input data, the stored estimated travel time and said stored actual travel time as a single learning data set, and a correction means for correcting the weighting factors set in said intermediate layer of the estimated travel time operation means selected by said switch-over means using the learning data.

* * * * *